United States Patent [19]

Ogawa

[11] Patent Number: 4,972,655

[45] Date of Patent: Nov. 27, 1990

[54] APPARATUS FOR MANUFACTURING SEALED POSTAL MAILS OR THE LIKE ENVELOPE ASSEMBLIES

[75] Inventor: Takao Ogawa, Kameoka, Japan

[73] Assignee: Iseto Shiko Co., Ltd., Japan

[21] Appl. No.: 382,102

[22] Filed: Jul. 19, 1989

[30] Foreign Application Priority Data

Jun. 30, 1987 [JP] Japan ..... 62-164956
Dec. 23, 1988 [JP] Japan ..... 63-326481

[51] Int. Cl.[5] ..... B65B 5/02; B65B 35/54; B65H 39/02; B31B 23/02

[52] U.S. Cl. ..... 53/155; 53/154; 53/237; 53/495; 53/569; 156/277; 156/362; 156/364; 156/517; 270/58; 364/478; 493/28; 493/216

[58] Field of Search ..... 53/154, 155, 206, 237, 53/238, 266 A, 495, 569; 156/226, 277, 362, 363, 364, 516, 517; 270/58; 364/478; 493/8, 11, 28, 35, 216

[56] References Cited

U.S. PATENT DOCUMENTS

| | | | |
|---|---|---|---|
| 2,427,839 | 9/1947 | Davidson | 270/58 |
| 3,059,391 | 10/1962 | Volks et al. | 53/206 |
| 3,260,517 | 7/1966 | Sather | 270/58 |
| 3,416,785 | 12/1968 | Sherman | 270/45 |
| 3,484,100 | 12/1969 | Sather et al. | 270/58 |
| 3,490,761 | 1/1970 | Bell . | |
| 3,570,840 | 3/1971 | Sather et al. | 270/58 |
| 3,641,319 | 2/1972 | McGuire | 156/362 |
| 4,026,000 | 5/1977 | Anderson | 156/73.4 |
| 4,033,807 | 7/1977 | Neill et al. . | |
| 4,034,973 | 7/1977 | Hams | 270/58 |
| 4,070,226 | 1/1978 | Crathern et al. | 156/364 |
| 4,223,882 | 9/1980 | Stocker | 493/11 |
| 4,261,497 | 4/1981 | Roetter et al. | 225/ |
| 4,312,169 | 1/1982 | Golicz et al. | 53/206 |
| 4,437,852 | 3/1984 | Volk, Jr. et al. | 493/216 |
| 4,455,809 | 6/1984 | Dallaserra | 53/435 |
| 4,471,598 | 9/1984 | Sanz | 53/266 A |
| 4,585,506 | 4/1986 | Matsuguchi | 156/363 |
| 4,797,830 | 1/1989 | Baggarly et al. | 53/153 |

FOREIGN PATENT DOCUMENTS

| | | |
|---|---|---|
| 64187 | 12/1945 | Denmark . |
| 0185811 | 12/1984 | European Pat. Off. . |
| 0297843 | 6/1988 | European Pat. Off. . |
| 3211791 | 3/1982 | Fed. Rep. of Germany . |
| 63-89338 | 4/1988 | Japan . |

OTHER PUBLICATIONS

Pitney Bowes, "Computer Output Mailing System", 1981.

*Primary Examiner*—William E. Terrell
*Attorney, Agent, or Firm*—Morgan & Finnegan

[57] ABSTRACT

Apparatus for manufacturing sealed postal mails or other sealed envelope assemblies using a discrete envelope blanks split from an envelope-forming continuous sheet, an intermediate element split from an intermediate element-forming continuous sheet and additional inserting elements, both having sizes adapted to be enclosed within the envelope blank. The apparatus includes a reader for reading an encoded data preliminarily printed on the intermediate elements that produces an output signal corresponding to the number of insert sheet elements to be enclosed together with the intermediate elements. A grouping station is provided for stacking the insert sheets successively supplied to be enclosed together with the intermediate elements. The grouping station is activated in response to the output signal from the reader. A feeder is provided for feeding a selective collection of inserting elements and intermediate elements from the grouping station to an envelope folding. Eventually, inserting these intermediate elements and inserting elements into each envelope at an insert station.

4 Claims, 5 Drawing Sheets

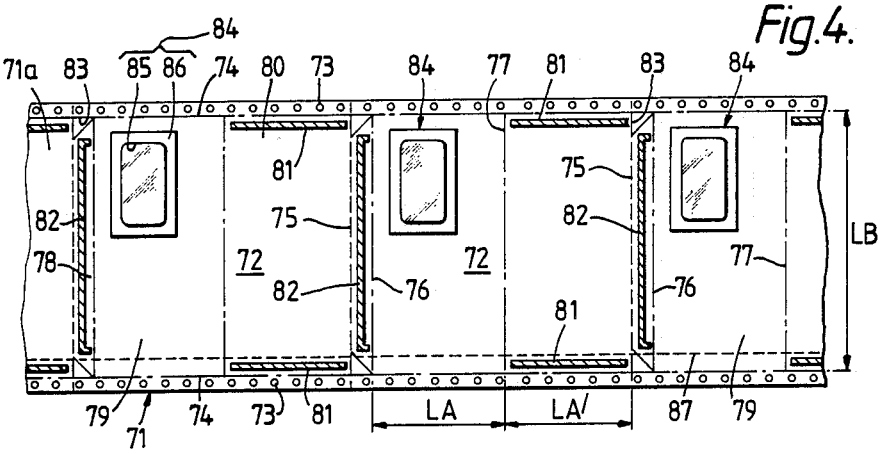
Fig.4.
84
71a
83
85
86
74
80
73
84
77
81
83
84
81
75
82
75
82
78
72
72
77
82
76
76
81
LB
79
71
74
73
81
LA
LA
87
79
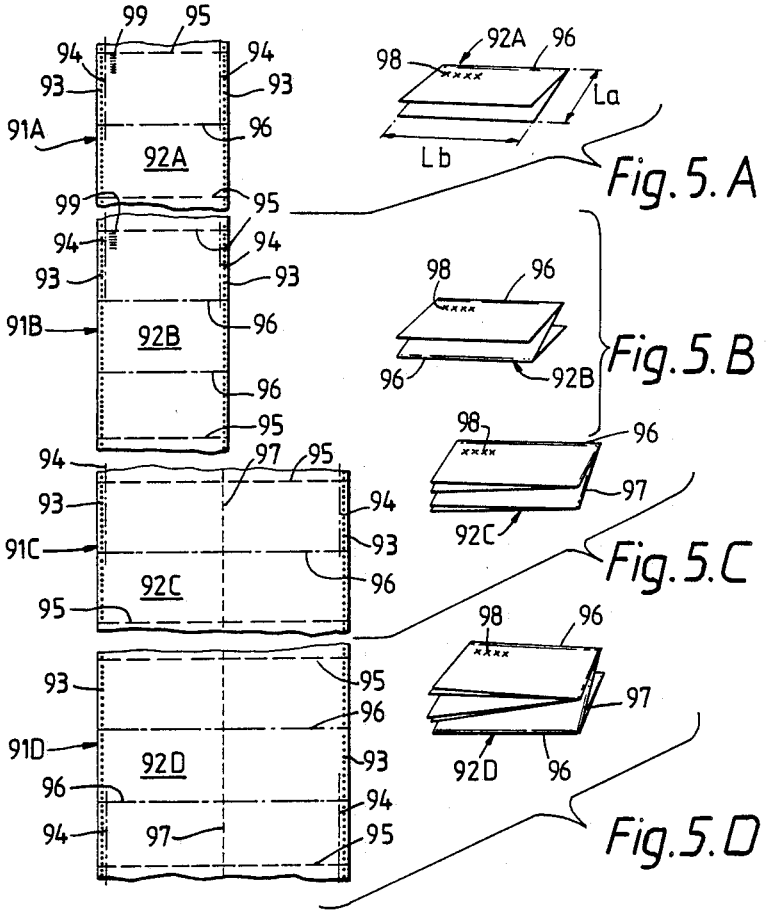
99
95
94
94
93
93
91A
96
92A
99
95
94
94
93
93
91B
96
92B
96
95
94
97
95
93
94
91C
93
96
92C
95
93
95
96
91D
92D
93
96
94
94
97
95
92A
96
98
La
Lb
Fig. 5. A
98
96
96
92B
Fig. 5. B
98
96
97
92C
Fig. 5. C
98
96
97
92D
96
Fig. 5. D Fig.6.A
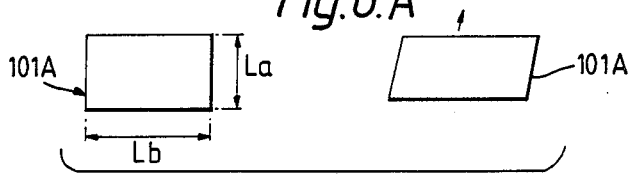
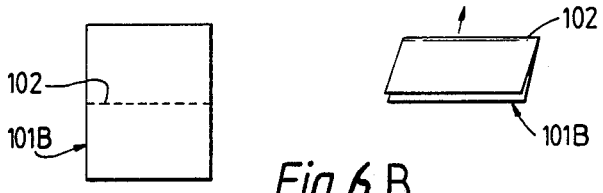
Fig.6.B
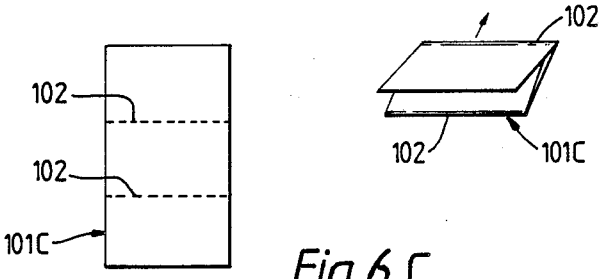
Fig.6.C
Fig.7.
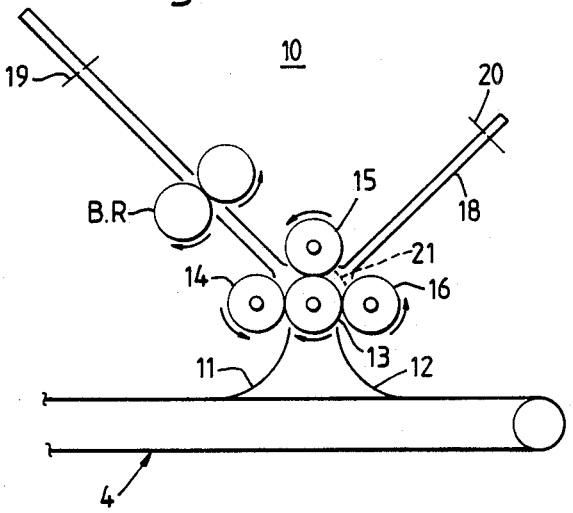

APPARATUS FOR MANUFACTURING SEALED POSTAL MAILS OR THE LIKE ENVELOPE ASSEMBLIES

BACKGROUND OF THE INVENTION

Cross-Reference to related application

This application is a continuation-in-part application of United States patent application Ser. No. 07/210,621 filed June 23, 1988, abandoned.

FIELD OF THE INVENTION

The present invention relates to an apparatus for manufacturing sealed postal mails or other sealed envelope assemblies each having a see-through window.

More particularly, the present invention relates to such an apparatus for manufacturing sealed postal mails and like envelope assemblies containing intermediate elements that remain free after comPleting the folding and sealing of envelopes wherein the apparatus processes such envelopes that can be cut off from a continuous sheet along the transverse folding line and folded into three parts (three parts comprising front layer, rear layer and sealing flap) at the transverse folding lines and also processes such discrete intermediate elements to be cut off from the continuous sheet or such as the one to be folded at least along a folding line.

The present invention relates to an apparatus for manufacturing sealed postal mails and like envelope assemblies, which first bursts a continuous sheet before forming transverse double-folded envelope blank having a sealing flap in the lengthwise direction, and in conjunction with envelope sealing process, the apparatus groups and gathers intermediate elements and inserting elements containing preliminarily processed data to be sent to each addressee, and in addition, it also groups those intermediate elements and inserting elements which are to be added selectively before the apparatus eventually inserts these elements between the transverse double-folded blank of the envelope-forming body.

DESCRIPTION OF PRIOR ART

Conventionally, there are a variety of apparatuses for Processing envelopes by allowing insertion of preliminary data-processed papers into individual envelopes during the envelope-forming process after bursting these envelopes from a continuous sheet designed for making up envelopes. On the other hand, relative to diversification of information to be conveyed, there is the need for changing the documents to be sealed in each envelope while the envelope-forming process is still underway. Actually, any of those conventional apparatuses employed for processing envelopes merely inserts conventional papers and prints into each envelope in the predetermined extent. As a result, any of those conventional apparatuses is not ideally suited for manufacturing envelopes needed for properly conveying constantly diversifying information.

SUMMARY OF THE INVENTION

The invention provides a novel apparatus for Processing envelope blanks, intermediate elements and inserting elements, while the apparatus related to the invention properly deals with diversified information to be conveyed by inserted documents and envelopes by materialing the following: detection and designation of the amount of intermediate elements by reading and identifying encoded data preliminarily printed on those intermediate elements; collection through grouping of inserting elements according to addresses either on a random basis or on a constant-number basis; and selective collection of inserting elements which are individually and preliminarily Prepared according to addresses before eventually inserting these unit papers into each envelope.

Another object of the present invention is to provide such a processing unit for the continuous mail sealing, which is suited for the line-printer process using a computer and in addition being particularly effective for the non-impact printing process using heat wherein it comprises such means for concentrically printing information onto a continuous sheet using a computer, while the printable continuous sheet is completely free from the heat-sensitive adhesive layer, and conversely, the heat-sensitive adhesive layer is provided only on the other continuous sheet available for envelopes.

A still further object of the present invention is to provide such a processing unit for the continuous mail sealing wherein it comprises such means for manufacturing sealed envelopes from which the inserted paper can be easily and immediately drawn out by opening at least one side of an envelope, while the sealed envelope contains the intermediate elements and inserting elements between the front and rear covers, allowing no part of the inserted elements to adhere to the interior of the sealed envelope. The preferred embodiments of the present invention are summarized below.

The present invention relates to such an apparatus that manufactures the sealed postal mails or the like envelope assemblies using a discrete envelope blanks split from an envelope-forming continuous sheet, an intermediate element split from an intermediate element-forming continuous and having sizes adapted to be enclosed within the envelope blank.

The envelope-forming continuous sheet having transverse weakening lines at regular intervals formed to define an envelope blank section between each adjoining two of the weakening lines, each of the envelope blank section having first and second transverse folding lines, a first area for forming the front layer of an envelope defined by first and second transverse folding lines, a second area for forming the rear layer of the envelope connected to the first area via the second transverse folding line, a third area for forming the sealing flap on the envelope connected to the first area via the first transverse folding line, a first adhesive layer formed on one surface of the envelope blank section along each of the opposite side edges in direction of the length of the envelope blank section, and a second adhesive layer formed on the same one surface of the envelope blank at the third area. The intermediate element-forming continuous sheet having transverse weakening lines at regular intervals formed to define an intermediate element section between each adjoining two of the weakening lines. Each of the intermediate element sections having its own specific information printed to be sent to addressee and each of the intermediate element sections further having thereon an encoded mark printed for indicating the number of sheets to be enclosed together when the intermediate element section is followed by at least one intermediate element which is to be sent to the same addressee.

The apparatus embodied by the invention substantially consists of the following:

(I) a stock of said envelope-forming continuous sheet;

(II) means for continuously supplying said envelope-forming continuous sheet from said stock;

(III) means for successively separating said envelope-forming continuous sheet supplied along said transverse weakening lines into discrete envelope blanks one by one;

(IV) envelope blank feeder means for feeding each of said discrete envelope blanks to an envelope folding and intermediate element inserting station;

(V) first gate means for controlling so as to intermittently feed one by one said envelope blank in the fed track of said envelope blank feeder means;

(VI) envelope blank retention means for retaining said envelope blank at said envelope folding and intermediate element inserting station;

(VII) a folding operation unit in said envelope folding and intermediate element inserting station, said folding operation unit comprising folding means for folding said discrete envelope blank along said second transverse folding line;

(VIII) stock of said intermediate element-forming continuously sheet;

(IX) means for continuously supplying said intermediate element-forming continuous sheet from said stock;

(X) reading means for reading said encoded mark on said intermediate element to produce an output signal corresponding to the number of insert sheets element to be enclosed together with said intermediate element;

(XI) means for successively separating said intermediate element-forming continuous sheet along said transverse weakening lines into discrete intermediate elements;

(XII) intermediate element feeder means for feeding said discrete intermediate elements to an intermediate element grouping station;

(XIII) grouping means located in said grouping station for stacking a plurality of insert sheets successively supplied to be enclosed together into a group of intermediate elements and said insert sheets to be enclosed together, said grouping means being operative in response to said output signal from said reading means;

(XIV) intermediate element group feeder means for feeding said group of intermediate elements and insert sheets from said grouping to station said envelope folding and intermediate element inserting station;

(XV) second gate means for controlling so as to align the front edges of said grouped intermediate elements and intermittently feed said grouped intermediate elements together in the feed track of said intermediate element feeder means;

(XVI) first sensor means for detecting the presence of said envelope blank in said envelope-blank retention means;

((XVII) second sensor means for detecting said group of intermediate elements fed to said intermediate element feed means;

(XIX) second gate control means responsive to the detect signal of said second sensor means and for controlling said second gate means;

(XX) first sealing means for sealing said envelope blank along said first adhesive layers of said envelope blank;

(XXI) flap folding means for folding said sealing flap of said envelope blank along said first transverse folding line of said envelope blank; and (XXII) second sealing means for sealing said envelope blank along said second adhesive layer of said envelope blank folded to form a completed envelope blank folded to form a completed envelope assembly.

BRIEF DESCRIPTION OF THE DRAWINGS

The invention will be better understood with reference to the description which follows taken in conjunction with the annexed drawings in which;

FIG. 4 is a partial plan view of the envelope-forming continuous sheet already processed for application to the apparatus embodied by the invention.

FIG. 5 -A, -B, -C and -D are respectively the plans denoting different types of intermediate elements forming continuous sheets and the perspective views of the corresponding intermediate elements;

FIG. 6, -A, -B and -C are respectively the plans denoting different types of additional inserting elements and the perspective views of the corresponding inserting elements;

FIG. 7 is the laterial view of the detailed constitution of the intermediate-element folding means.

DESCRIPTION OF PREFERRED EMBODIMENTS

Figure 1:
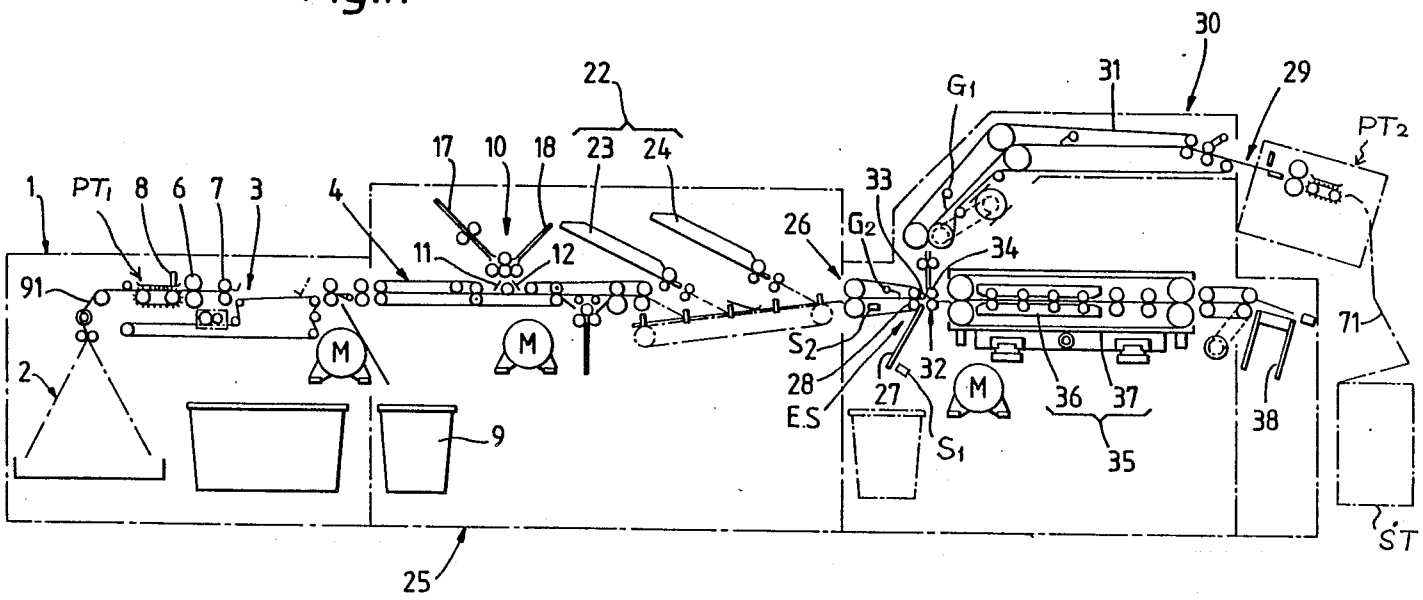
FIG. 1 is the simplified schematic lateral diagram of the envelope/intermediate element manufacturing and sealing apparatus related to the invention.

Referring now to the preferred embodiments shown in the attached drawings, details of the apparatus for manufacturing sealed postal mails or like envelope assemblies reflecting the present invention are described below.

Basically, the sealed mail manufacturing apparatus embodied by the present invention is designed to continuously make up envelope units (E.U.) by individually feeding the following into the apparatus; discrete envelopes (72) split from a continuous sheets (71) available for envelopes, discrete intermediate elements (92) made from intermediate-forming continuous sheet (91) available for intermediate elements and additional inserting elements (101) selectively insertable as required. An example of the envelope forming continuous sheet (71) is shown in FIG. 4. This envelope forming continuous sheet (71) is provided with marginal perforation lines (73) and (73) along opposite edges in the direction of its length and also with the marginal perforation split lines (74) and (74) so that the marginal perforation lines (73) and (73) can be cut off along the internal line of these lines (73) and (73).

Said envelope-forming continuous sheet (71) is provided with tearable transverse weakening line (75) at regular interval in the direction of length, thus defining the area available for the discrete envelope blank (72). The envelope blank (72) sectioned by said transverse weakening line (75) is provided with the first folding line (76) and the second folding line (77) in parallel with said transverse weakening line (75) The envelope blank (72) is also provided with sealing flap (78) formed between the transverse weakening line (75) and the first holding line (76), front area (79) formed between the first folding line (76) and the second folding line (77)

and the transverse weakening line (75). Length (LA) in the lengthwise direction of the front area (79) substantially constitutes one side (a short side of the envelope of the envelope shown in FIG. 4) of the envelope itself. When actually designing envelopes, the length (LA.) in the lengthwise direction of the rear area (80) is slightly shorter than (LA). The dimension (LA) and (LB) of the sealed envelope unit (EU) is optionally chosen, i.e., the dimension may be LA<LB as shown in the illustrated preferred embodiment, or it may conversely be LA≧LB. The envelope blank of the continuous sheet (71) is provided with the first and second adhesive-agent coated zones (81) and (82) for sealing the envelope itself in the direction of folding the second folding line (77) into inner surface (71*a*). The first adhesive-agent coated zones (81), (81) are respectively formed in parallel with each other along the inner edge of said marginal perforation split lines (74), (74), whereas the second adhesive-agent coated zones (82), (82) are respectively formed in the direction of traversing the sealing flap (78). Either thermally pressing type adhesive agent, or pressure-applied adhesive agent, or water-soluble starch may also be used for making up those adhesive-agent coated zones (81) and (82).

Referring now to the sealing flap (78), an isosceles triangular diecut (83) is provided in conjunction with the transverse weakening line (75) and the marginal perforation split line (74). The length of each side of isosceles forming the diecut (83) almost matches the length of the sealing flap (78). Portion (79) making up the front area of the envelope-forming continuous sheet (71) is provided with a see-through window (84) at an optional location. Such a see-through window (84) may be formed by bonding a transparent sheet (86) to the opening (85) on the front area (79) from the inner surface (71*a* ) of the envelope-forming continuous sheet (71) using adhesive agent for example. Alternatively, the see-through window (84) may be of such a constitution which allows only limited portion of information (i.e., address and addressee) written on the inserted document to be externally visible. Perforated line (87) shown in FIG. 4 used for opening the sealed envelope is provided in parallel with the inner edge of either of the first adhesive-agent coated zones (81) and (81).

FIG. 5-A, -B, -C and -D, respectively denote styles of a variety of continuous sheets (91) for the intermediate elements to be inserted into envelopes. Each of those continuous sheets (91) is used for making up intermediate elements. Those continuous sheets (91A), (91B), (91C) and (91D) are respectively provided with marginal perforation lines (93) and (93) along both sides and in the lengthwise direction. In addition, these continuous sheets (91A), (91B), (91C) and (91D) are also provided with split lines (94) and (94) to cut off those marginal perforation lines (93) and (93) along the inner side of these perforation lines. Continuous sheet (91A) shown in FIG. 5-A continuously forms a transverse double-folded intermediate element (92A) having a transverse folding line (96). Continuous sheet (91B) shown in FIG. 5-B continuously forms a transverse triple-folded intermediate element (92B) having a pair of transverse folding lines (96) and (96) between transverse weakening lines (95) and (95). Continuous sheet (91C) shown in FIG. 5-C continuously forms a cross-folding (double-folding in the transversal and longitudinal directions) intermediate element (92C) having the central folding line (97) in the lengthwise direction and transverse folding line (96) between transverse weakening lines (95) and (95). Continuous sheet (91D) shown in FIG. 5-D continuously forms a cross-folding (triple folding in the transversal direction and double-folding in the longitudinal direction) intermediate element (92D) having the central folding line (97) in the lengthwise direction and a pair of transverse folding lines (96) and (96) between transverse weakening lines (95) and (95). When being folded, side length (La) of each of these intermediate elements (92A), (92B), (92C) and (92D) is slightly shorter than the length (LA) of the sealed envelope unit (EU), and likewise, the other side length (Lb) is also slightly shorter than the inner length of the first adhesive-agent coated zones (81) and (81) of the sealed envelope unit (EU). Space for printing address and addressee is provided for the external surface of any of those intermediate elements (92A), (92B), (92C) and (92D). Identification encoded mark (99) is preliminarily printed on each of these intermediate element-forming continuous sheets(91A), (91B), (91C) and (91D) in order that intermediate elements can properly be grouped and gathered according to addresses and addressees. The identification encode mark (99) is provided for each unit of intermediate element(92) and composed of 7-bit bar code for example. The identification encode mark (99) is read and identified by an encode-mark sensor set to the apparatus related to the invention, and based on the identified encode mark, instructions are generated to group and gather intermediate elements (92) as per addresses and addressees, selectively insert additional inserting elements (101), and divert the non-printed intermediate elements.

FIG. 6-A, -B and -C respectively denote examples of a variety of additional inserting elements (101). These elements (101) are not split from a continuous sheet, but each of these elements (101) consists of either a single leaf (101A) or a preliminarily folded and cut sheet (101B) or (101C) for example. FIG. 6-A represents a single-leaf additional inserting element (101A). FIG. 6-B represents a transverse double-folded additional inserting element (101B) having a transversely folding line (102). FIG. 6-C represents a transverse triple-folded additional inserting element (101C) having a pair of transverse folding lines (102) and (102).

Figure 2:
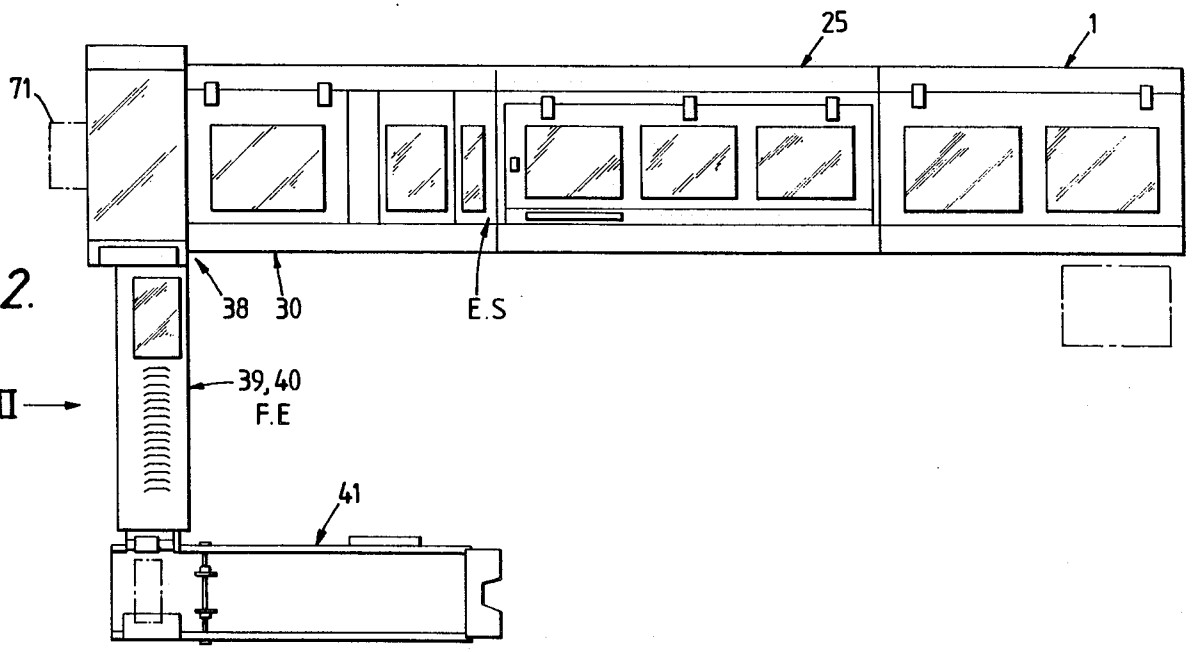
FIG. 2 is the schematic plain of the apparatus shown in FIG. 1.
Figure 3:
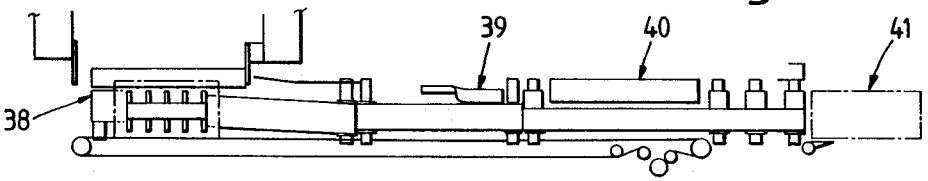
FIG. 3 is the lateral view of part of the apparatus corresponding to the arrowed portion of FIG. 2.
Figure 8:
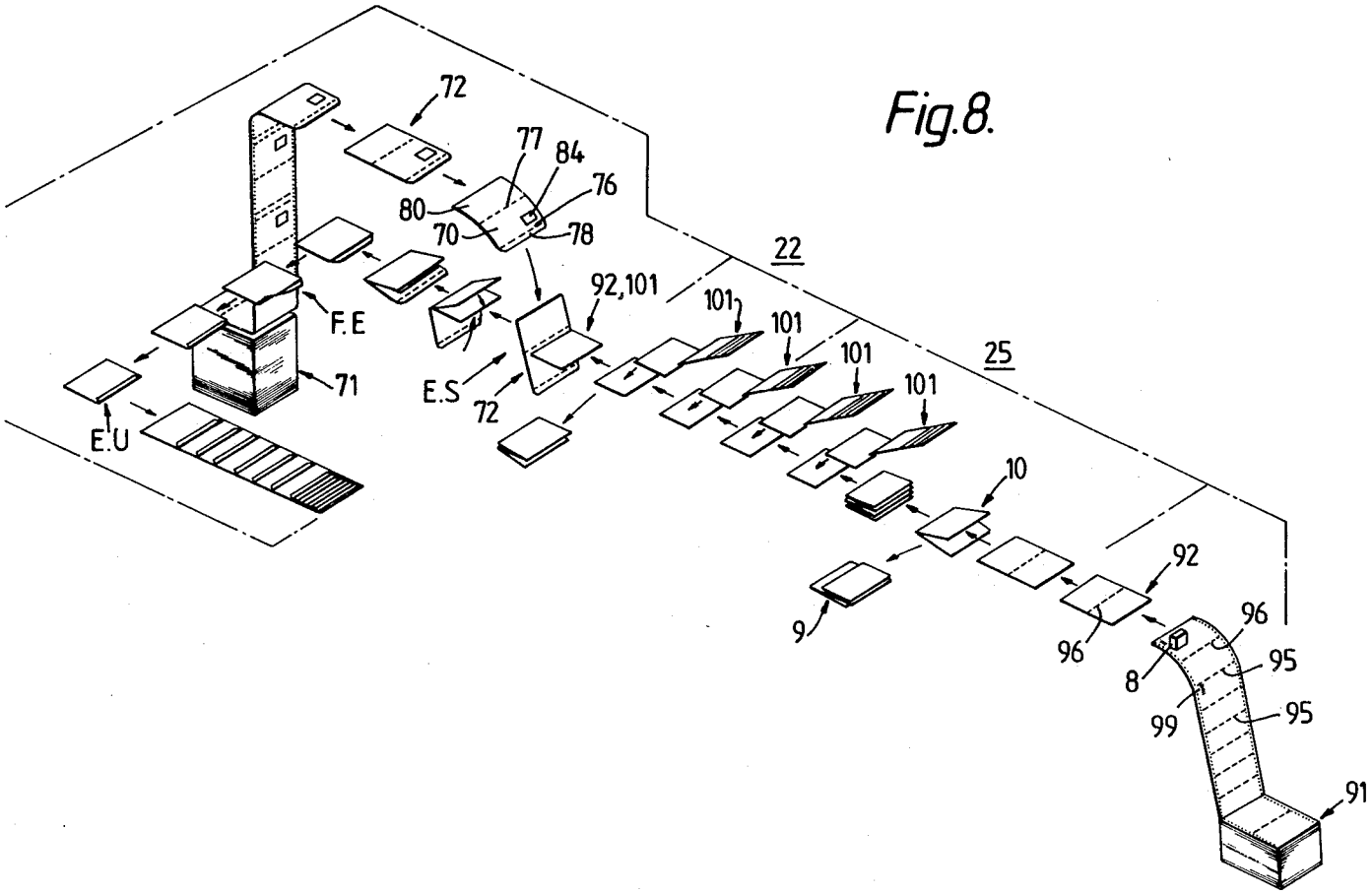
FIG. 8 is an overall schematic/perspective view denoting the systematic flow of the envelope-forming continuous sheet, the intermediate element forming continuous sheet, and the additional inserting elements.

Next, referring more particularly to those preferred embodiments shown in FIG. 1, FIG. 2 and FIG. 3, the constitution of the apparatus related to the invention is described below. The intermediate-element supplying system (1) is composed of stocker (2) which stocks the intermediate-element forming continuous sheet (91), separating means (3) which separates the continuous sheet (91) into intermediate element (92), and the feeding means (4) which feeds intermediate element, respectively. Following the printing process executed with computer means, first, the intermediate-element forming continuous sheet (91) shown in FIG. 5 is split into intermediate elements by the separating means (3) which is provided with marginal slitter (6) and bursting device (7). The OMR (optical mark reading) sensor (8) shown in FIG. 5 reads and identifies encode mark (99) preliminarily printed on each of those intermediate elements. The feeding means (4) connected to the outlet of the separating means (3). When activating the apparatus related to the invention, non-printed intermediate element (92) is detected by OMR sensor (8) which reads and identifies encode mark (99) Printed on each of the intermediate elements. Those inserted non-printed elements (92) are then removed from the intermediate element feeding line and collected by non-printed element tray (9). In conjunction with the intermediate element feeding means (4), transverse-folding means (10) is provided for transverse folding those intermediate elements (92). FIG. 7 denotes an example of the transverse-folding means (10) which is composed of intermediate-element introducing guide member (11), insertable-intermediate-element forwarding guide member (12), the first through fourth rollers (13) through (16), and the first and second guide stoppers (17) and (18), respectively. Guide stoppers (17) and (18) are respectively provided with stoppers (19) and (20) which adjust their positions to stop the movement of the intermediate elements (92). Each of intermediate elements (92) is led between a pair of rollers (13) and (14) along the introduction guide member (11) before being led to the first guide stopper (17) by rollers (13) and (14). Each of intermediate elements (92) bends itself at the inlet portion of rollers (13) and (15) with its tip edge being in contact with stopper (19) and then the insertable paper itself is pressed by rollers (13) and (15) before eventually being folded transversely. Transverse double-folded intermediate element (92A) shown in FIG. 5-A dispenses with the secondary folding otherwise to be done in the transversal direction. In this case, after passing through a pair of rollers (13) and (15), intermediate element sertable paper (92) is then directly led by guide member (21) provided in place of the guide stopper (18) so that the intermediate element (92) can pass through rollers (13) and (16) before being discharged to the feeding line. Those intermediate elements (92C) and (92D) each having a longitudinal folding line shown in FIG. 5-C and 5-D are preliminarily provided with vertical folding process by the longitudinal folding unit (not shown). The transverse folding means (10) turns the fed intermediate element (92) upside down using guide member (21). In this case, the distance between stopper (19) of the first guide stopper (17) and rollers (13) and (14) is extended in order that the distance can be longer than the length of the intermediate element (92) itself. The intermediate element (92) carried into the first guide stopper (17) is then delivered to a pair of rollers (13) and (15) by a pair of back rollers (B.R.).

On the other hand, in conjunction with the inserting-element feeding line, additional inserting-element feeding means (22) is provided. This means (22) is provided with the first and second feeding units (23) and (24) for example, which respectively insert printed papers into envelopes. Furthermore, the apparatus related to the invention is provided with paper grouping and collecting means (25), which first reads and identifies encode marks printed on the intermediate elements, and then stores those intermediate elements by each inserting unit. In addition, this grouping means (25) selectively adds additional inserting elements stored in the additional inserting element feeding means (22) to the original intermediate element (92), and finally, it groups and collects those intermediate elements according to addresses and addressees. The paper grouping and collecting means (25) is provided with function for randomly collecting intermediate elements, precisely collecting intermediate elements by the Predetermined number, and selectively inserting additional elements into each envelope, respectively. When the apparatus related to the invention activates the random paper grouping and collecting function, the OMR sensor reads and identifies the encode marks on the intermediate elements according to the predetermined rule, and then, acting on the instruction signal, grouping and collection of intermediate elements by random number can be executed. Grouping and collection of the intermediate elements by the predetermined number can be executed without referring to encode marks on those elements, but merely by inserting a specific number of those intermediate elements of each lot.

On the other hand, when activating function for selectively inserting additional inserting elements, a specific mechanism having two of the additional inserting element feeding means generates instructions for selecting any of four functional operations including delivery of the first and second additional inserting elements, executing independent delivery of only the first additional inserting elements and only the second additional inserting elements, and with holding delivery of both the first and second additional inserting elements, respectively. All of these instructions are generated as a result of reading and identifying encode marks on each of intermediate elements (92). The apparatus related to the invention feeds additional inserting elements (101) to the original intermediate element (92). Both the grouped original intermediate elements (92) and additional inserting elements (101) are then delivered to the inserting-unit delivery means (26).

Said intermediate element feeder (26) is predetermined to feed said intermediate element in supply velocity (V2) to said envelope folding and intermediate element inserting station (E.S.).

In conjunction with said intermediate element feeder (26), the second sensor (S2) and the second gate (G2) is provided. Said second sensor (S2) outputs the detecting signal (e2) when detecting said intermediate elements at the intermediate element feeder (26). Said second gate (G2) is provided at the feed track of said intermediate element feeder (26), with the object of aligning the tip-end of said group of intermediate elements. Said second gate (G2) is predetermined to open in response to said detecting signal (e2) from said second sensor (S2) when said tip-end of said intermediate elements at said second gate (G2).

The paper-forwarding roller (28) classifies and collects each of intermediate element and inserting elements, and finally, it forwards each of the grouped inserting unit in order that each of these can come into contact with the second folding line (77) of the envelope blank (72).

On the other hand, the apparatus related to the invention is also provided with envelope-blank supplying system (30) which first activates separating means (29) to separate the envelope-forming continuous sheet (71) into individual envelope blanks (72) and then conveys these envelope blanks (72) to the inserting station (E.S.). Discrete envelope blank (72) is then fed to the predetermined inserting station (E.S.) by feeding means (31). The inserting station (E.S.) is provided with the envelope-blank holder means (27). This holder means holds the envelope-blank (72) almost at right angle against the intermediate elements (92) which are horizontally forwarded by the intermediate element delivery means (26.). Then, the envelope-blank holder means (27) aligns the position of the second transverse folding line (77) of the envelope blank (72) in order that the transverse folding line(77) can correctly match the paper-inserting line. This allows each envelope blank (72) to be held at standby posture at the predetermined position.

Said envelope blank feeder (30) is predetermined to feed said envelope blank in supply velocity (Vl) to said envelope folding and intermediate element inserting station (E.S.). Said supply velocity (V1) of said envelope blank being greater than said supply velocity (V2) of said intermediate element, so that envelope blank (72) is predetermined to wait at said envelope blank folding and intermediate element inserting station (E.S.).

In conjunction with said envelope blank feeder (30), the first sensor (S1) and the first gate (G1) is provided. Said first sensor (S1) outputs the detecting signal (El) when sensing in the absence of said absence envelope blank retention means (27). Said first gate (G1) is provided at the feed track of said envelope blank feeder (30), with the object of intermittently feeding one by one said envelope blank. Said first gate (G1) is predetermined to open in response to said detecting signal (el) from said first sensor (S1). In addition, folding roller means (32) is installed to the rear stage of the envelope-blank holder means (27). The folding roller means (32) is composed of a pair of rollers (34) and (34) to allow the inlet aperture (33) to open itself in order that these rollers (34) and (34) correctly align the second transverse folding line (77) of the envelope blank (72) with the aperture (33). In conjunction with the movement of the intermediate element delivery means (26) to forward intermediate elements the envelope blank (72) is folded along the second transverse folding line (77), and then, the envelope blank (72) is led into the rear-stage rollers (34) and (34) before eventually being folded when passing through rollers (34) and (34).

On the other hand, the first sealing means (35) is installed to the rear stage of the folding roller means (32). The first sealing means (35) is composed of a pair of heaters (36) and (36) and pressurized conveyor belt (37). Heaters (36) and (36) are respectively installed along the predetermined path of the first adhesive-agent coated zones (81) and (81) of the envelope body, i.e., in the manner of facing both sides of the envelope in the forwarding direction. Each envelope with both sides being fused by the first sealing mechanism (35) is then led into the movement-path changing means (38) to allow either of the fused sides to precede by changing the direction of the movement of envelope by 90 degrees. Then, the envelope body is delivered to the flap-enveloping unit (F.E.) which is provided with the flap folding means (39) and the second sealing means (40). By operating the flap-folding means (39), the flap-enveloping unit (F.E.) folds envelope flap (78) along the first transverse folding line (76) before fully sealing the envelope body with the second sealing means (40). Finally, each of the completely sealed envelopes is conveyed to the following workshop via the delivery unit (41) according to purposes.

When automatically inserting and enveloping documents or the like into individual envelopes by operating the automatic envelope and insertable paper processing apparatus embodied by the invention featuring the novel constitution thus far described, by virtue of reading and identifying encode marks preliminarily printed on each of intermediate elements and inserting elements, the apparatus can correctly detect and instruct the amount of papers to be inserted into each envelope before effectively classifying these papers and envelopes according to addressees. The grouping operation of envelope-intermediate elements can be executed either randomly or on the basis of constant number, and yet, whenever necessity arises, the apparatus related to the invention selectively classifies and collects each of Preliminarily prepared additional inserting elements before fully enclosing them as a unit into the designated envelopes. These functions constitutes a novel envelope and intermediate element processing apparatus which securely deals with diversification of information to be sent.

Furthermore, the envelope and intermediate element processing apparatus related to the invention changes the direction of feeding each envelope by 90 degrees before fully sealing envelope bodies. When executing final sealing oPeration, the apparatus discretely uses different heater units for thermally sealing each envelope along the vertical and lateral edges so that thermal sealing can locally be achieved. This effectively prevents the paper-inserted portion of each portion of each envelope from adversely being affected by heating and pressurized effect, thus totally eliminating adverse influence otherwise incurring to the enclosed computer-processed printed documents.

What is claimed is:

1. An apparatus for manufacturing sealed envelope assemblies using a discrete envelope blank split from an envelope-forming continuous sheet and at least one intermediate element split from an intermediate element-forming continuous sheet, each envelope comprising a front layer, a rear layer and a sealing flap, said envelope-forming continuous sheet having transverse weakening lines at regular intervals formed to define an envelope blank section between each adjoining two of said weakening lines, said envelope blank section having first and second transverse folding lines, a first area for forming a front layer of said envelope, said first area being defined by said first and second transverse folding lines, a second area for forming a rear layer of said envelope, said second area being connected to said first area via said second transverse folding lines, a third area for forming a sealing flap of said envelope, said third area being connected to said first area via said first transverse folding lines, a first adhesive layer formed on one surface of said envelope blank section along each of the opposite side edges in directions of the length of said envelope blank section, a second adhesive layer formed on the same one surface of said envelope blank at said third area, said intermediate element-forming continuous : sheet having transverse weakening lines at regular intervals formed to define a intermediate element section between each adjoining two of said weakening lines, each of said intermediate element sections having its own specific information printed to be sent to addressee and each of said intermediate element sections further having thereon an encoded mark printed for indicating the number of insert sheets to be enclosed together when said intermediate element section is followed by at least one insert sheets which is to be sent to the same addressee, said apparatus comprising:

(I) a stock of said envelope-forming continuous sheet;

(II) means for continuously supplying said envelope-forming continuous sheet from said stock;

(III) means for successively separating said envelope-forming continuous sheet supplied along said transverse weakening lines into discrete envelope blanks one by one;

(IV) envelope blank feeder means for feeding each of said discrete envelope blanks to an envelope folding and intermediate element inserting station;

(V) first gate means for controlling so as to intermittently feed one by one said envelope blank in the feed track of said envelope blank feeder means;

(VI) envelope blank retention means for retaining said envelope blank at said envelope folding and intermediate element inserting station:

(VII) a folding operation unit in said envelope folding and intermediate element inserting station, said folding operation unit comprising folding means for folding said discrete envelope blank along said second transverse folding line;

(VIII) a stock of said intermediate element-forming continuous sheet;

(IX) means for continuously supplying said intermediate element-forming continuous sheet from said stock;

(X) reading means for reading said encoded mark on said intermediate element to produce an output signal corresponding to the number of insert sheets to be enclosed together with said intermediate element;

(XI) means for successively separating said intermediate element-forming continuous sheet along said transverse weakening lines into discrete intermediate elements;

(XII) intermediate element feeder means for feeding said discrete intermediate elements to an intermediate element grouping station;

(XIII) grouping means located in said grouping station for stacking a plurality of insert sheets successively supplied to be enclosed together into a group of intermediate elements and said insert sheets to be enclosed together, said grouping means being operative in response to said output signal from said reading means;

(XIV) intermediate element group feed means for feeding said group of intermediate elements and insert sheets from said grouping to station said envelope folding and intermediate element inserting station;

(XV) second gate means for controlling so as to align the front edges of said grouped intermediate elements and intermittently feed said grouped intermediate elements together in the feed track of said intermediate element feeder (XVI) first sensor means for detecting the presence of said envelope blank in said envelope-blank retention means;

(XVII) first gate control means responsive to the detect signal from said first sensor means and for controlling said first gate means;

(XVIII) second sensor means for detecting said group of intermediate elements fed to said intermediate element feeder means;

(XIX) second gate control means responsive to the detect signal of said second sensor means and for controlling said second gate means;

(XX) first sealing means for sealing said envelope blank along said first adhesive layers of said envelope blank;

(XXI) flap folding means for folding said sealing flap of said envelope blank along said first transverse folding line of said envelope blank; and (XXII) second sealing means for sealing said envelope blank along said second adhesive layer of said envelope blank folded to form a completed envelope assembly.

2. Apparatus defined in claim 1, further including non-printed intermediate element detecting means for detecting any non-printed intermediate element to produce an output signal; and means responsive to said signal from said nonprinted intermediate element detecting means and for removing said non-printed intermediate element from a intermediate element feeding line.

3. Apparatus defined in claim 1, further including; means for supplying another intermediate elements to said grouping station to prepare a further group of intermediate elements of different kinds to be enclosed together.

4. Apparatus defined in claim 3, wherein said encoded- mark is capable of additional indicating selective additional of said another intermediate element and said means supplying said another intermediate element is operative in response to the output signal from said reading means.

* * * * *